US008276874B2

(12) United States Patent
Schwoerer

(10) Patent No.: US 8,276,874 B2
(45) Date of Patent: Oct. 2, 2012

(54) CEILING FORMWORK SYSTEM

(75) Inventor: Artur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 890 days.

(21) Appl. No.: 11/988,061

(22) PCT Filed: Jun. 30, 2006

(86) PCT No.: PCT/EP2006/006366

§ 371 (c)(1),
(2), (4) Date: Jan. 28, 2009

(87) PCT Pub. No.: WO2007/003364

PCT Pub. Date: Jan. 11, 2007

(65) Prior Publication Data

US 2009/0211195 A1 Aug. 27, 2009

(30) Foreign Application Priority Data

Jul. 4, 2005 (DE) ..... 10 2005 031 153
Mar. 31, 2006 (DE) ..... 10 2006 015 054

(51) Int. Cl.
*E04G 11/00* (2006.01)
*E04G 17/00* (2006.01)

(52) U.S. Cl. ..... 249/18; 249/210

(58) Field of Classification Search ..... 249/18, 249/19, 20; 108/153.1–158.13, 64, 90, 91, 108/137, 143, 59, 67, 102, 185; 248/188, 248/188.1

See application file for complete search history.

(56) References Cited

U.S. PATENT DOCUMENTS

| | | | | | |
|---|---|---|---|---|---|
| 622,666 | A * | 4/1899 | Burwell | 182/223 |
| 1,118,282 | A * | 11/1914 | Hodges | 249/18 |
| 1,294,264 | A | 2/1919 | Herman | |
| 1,997,432 | A * | 4/1935 | Replogle | 211/153 |
| 2,888,305 | A * | 5/1959 | Perry | 108/65 |
| 3,670,351 | A * | 6/1972 | Drury | 14/77.1 |
| 3,889,779 | A * | 6/1975 | Kummerlin | 182/223 |
| 4,036,466 | A * | 7/1977 | Van Meter | 249/18 |
| 4,353,140 | A * | 10/1982 | Graber | 5/505.1 |
| 4,553,523 | A * | 11/1985 | Stohrer, Jr. | 126/9 B |
| 6,189,527 | B1 * | 2/2001 | Walsh et al. | 126/25 R |
| 6,189,854 | B1 * | 2/2001 | Irurzun Saez De Maturana | 249/18 |

FOREIGN PATENT DOCUMENTS

| | | |
|---|---|---|
| DE | 812 015 C | 8/1951 |
| DE | 928 912 C | 6/1955 |
| DE | 23 52 949 A1 | 4/1975 |
| DE | 29 07 884 A1 | 3/1979 |
| DE | 102 34 445 A1 | 2/2004 |

* cited by examiner

*Primary Examiner* — Darnell Jayne
*Assistant Examiner* — Timothy M Ayres
(74) *Attorney, Agent, or Firm* — Kilpatrick Townsend & Stockton LLP

(57) ABSTRACT

The invention relates to a ceiling formwork system comprising several grid elements, each of which is composed of a plurality of parallel longitudinal beams and at least one transversal beam that can be mounted or placed on vertical supports and extends perpendicular to the longitudinal beams. The longitudinal and transversal beams of the grid elements are rigidly interconnected. Standard grid elements are provided with two transversal beams in the opposite terminal areas of the longitudinal beams while transversal compensating grid elements are fitted with two transversal beams which are offset towards the inside in relation to the standard grid elements.

18 Claims, 13 Drawing Sheets

CEILING FORMWORK SYSTEM

CROSS-REFERENCES TO RELATED APPLICATIONS

This application is a U.S. National Phase and claims the benefit of PCT Patent Application No. PCT/EP2006/006366 filed Jun. 30, 2006, which claims the priority of German Patent Application No. 10 2006 015 054.6 filed Mar. 31, 2006 and German Patent Application No. 10 2005 031 153.9 filed Jul. 4, 2005, the disclosures of which are incorporated herein by reference.

BACKGROUND OF THE INVENTION

The invention relates to a slab formwork system comprising a plurality of grid elements which each consist of a plurality of longitudinal beams extending parallel to one another and at least one cross beam which can be installed on or placed onto vertical supports and extends transversely to the longitudinal beams.

A slab formwork system of this type is known from the German laying open specification DE 102 34 445 A1 of the applicant. In this system, a plurality of longitudinal beams extending parallel to one another are connected to one another via rails provided at their lower side to form grid elements such that the relative positions of the longitudinal beams are fixed with respect to one another. The named rails are provided spaced apart at a comparatively large distance from the end-face ends of the longitudinal beams.

On the assembly of the known slab formwork system, cross beams are first installed onto vertical supports, whereupon the grid beams having longitudinal beams extending perpendicular to the cross beams consisting of the longitudinal beams and the rails and each being the same as the other can then be placed onto the cross beams from above. In view of the fact that the longitudinal beams are not fixedly connected to the cross beams and the rails are provided spaced apart from the end-face ends of the longitudinal beams, it is possible to mesh grid elements mutually adjacent in the longitudinal direction with one another such that in each case a section of a longitudinal beam of a grid element comes to lie between two longitudinal beams of a grid element meshed therewith. In this manner, a longitudinal compensation can be carried out by the named meshing of the grid elements, which means that individual dimensions can be adopted in the longitudinal direction of the longitudinal beams with the named slab formwork system, the dimensions being able to be selected independently of the grid dimension of the grid elements.

BRIEF SUMMARY OF THE INVENTION

An object of the invention consists of further developing a slab formwork system of the initially named kind such that a slab formwork can not only be adapted to individual size relationships in the direction of the longitudinal beams, but also perpendicular thereto, with an assembly and disassembly of the slab formwork system in particular also being able to be ensured which is as fast, as simple and as safe as possible.

This object is satisfied in accordance with the invention and in particular in that longitudinal beams and cross beams of the grid elements are rigidly connected to one another, with standard grid elements having two cross beams provided in the end regions of the longitudinal beams remote from one another, whereas transverse compensation grid elements have one or two cross beams arranged inwardly offset in comparison to the standard grid elements.

In accordance with the invention, the longitudinal beams of a grid element are therefore not connected to one another in a known manner via separate rails, but the connection of the longitudinal beams of a grid element is realized directly via one or more cross beams which are fixedly connected to the longitudinal beams and which are in turn suitable to be placed or mounted on vertical supports. In this respect, it is therefore already achieved in accordance with the invention that the number of the parts to be handled is reduced with respect to known slab formwork systems since cross beams and longitudinal beams each form firmly mutually connected units or grid elements so that cross beams and longitudinal beams no longer have to be handled separately from one another.

Furthermore, the grid elements are made available within the framework of a system in accordance with the invention in at least two embodiments differing from one another, with the above-defined standard grid elements, just like the already named transverse compensation grid elements, being specifically realized here. On the installation of a slab formwork system whose size corresponds in every direction to a whole number multiple of the respective grid dimension of the standard grid elements, it is possible to use only standard grid elements which are in no way meshed with one another. When, however, it is e.g. necessary to create individual dimensions outside the grid dimension in a direction extending perpendicular to the longitudinal beams, transverse compensation grid elements are also used in accordance with the invention in addition to the standard grid elements. These transverse compensation and grid elements differ from the standard grid elements in that its or their cross beams are arranged offset further inwardly. It becomes possible by this surprisingly simple measure to mesh a standard grid element and a transverse compensation grid element with one another such that an outer longitudinal beam or also a plurality of outer longitudinal beams of a cross beam grid element each come to lie between two adjacent longitudinal beams of the standard grid element. In this case, all the longitudinal beams of the standard grid element and of the transverse compensation grid element then extend parallel to one another, with them all being arranged spaced apart from one another transversely to their longitudinal direction or adjacent to one another at their longitudinal sides. Individual, continuously adjustable dimensions not bound to any grid dimension can thus be realized in a transverse direction extending perpendicular to the longitudinal beams in that the respectively desired number of longitudinal beams of a transverse compensation grid element is positioned between two respectively adjacent longitudinal beams of a standard grid element. It is ensured by the mutually different attachment of the cross beams to the standard grid elements and to the transverse compensation grid elements that the cross beams of standard grid elements and transverse compensation grid elements meshing with one another do not collide with one another. The cross beams of all grid elements meshing with one another rather extend either spaced apart from one another perpendicularly or the cross beams of grid elements meshing with one another contact one another.

It is preferred for the longitudinal beams of the standard grid elements to have the same length as those of the transverse compensation grid elements. Within the framework of a slab formwork system, however, two or more classes or types of grid elements with dimensions respectively differing from one another can easily be used, for example, with standard grid elements and at least corresponding transverse compensation grid elements then existing for each class whose longitudinal beams have the same dimensions as those of the standard grid elements of the respective class. A system of this type which uses e.g. two different classes of standard grid elements and correspondingly formed transverse compensation grid elements will be described in more detail within the framework of the description of the Figures.

When the longitudinal beams of the standard grid elements of one type have the same length as those of the transverse compensation grid elements of the same type, it is not possible to guide transverse compensation grid elements in a linear manner from below up to an already installed standard grid element and to mesh with it within the framework of a purely linear movement since in this case the mutually remote ends of the longitudinal beams of the transverse compensation grid element would collide with the cross beams of the standard grid element. In this case, the cross compensation grid element in accordance with the invention is rather "threaded" into the standard grid element from below, which means that the one end-face ends of a respectively desired number of longitudinal beams of the transverse compensation grid element are first introduced from below between the respective longitudinal beams of the standard grid element and are moved beyond the one cross beam of the standard grid element from the inside to the outside. This movement is then continued in the direction of the longitudinal beam until the other ends of the longitudinal beams of the transverse compensation grid element can be raised over the other cross beam of the standard grid element and can be supported on it. The process of threading in will be explained even more thoroughly within the framework of the description of the Figures.

It is furthermore of advantage for the spacing of adjacent longitudinal beams of the grid elements to amount to at most 20 cm. With such spacings, it can be avoided with the highest possible security that a fitter can fall between two adjacent longitudinal beams, so that an assembled grid element in accordance with the invention represents a reliable security against falling. The spacing of adjacent longitudinal beams must, however, be at least as large as the width of the longitudinal beams so that a longitudinal beam of a transverse compensation grid element can be moved between two adjacent longitudinal beams of a standard grid element. It is particularly preferred for the spacing of adjacent longitudinal beams of the grid elements to amount to at least twice or three times the width of the longitudinal beams. In this case, it is then possible to work additionally with longitudinal compensation grid elements and/or combination compensation grid elements, which will be looked at in more detail in the following. It is generally also possible to increase the spacing of adjacent longitudinal beams to at least five times the width of the longitudinal beams. In this manner, additional combination possibilities of all available grid elements are made possible.

It is particularly preferred for the already mentioned longitudinal compensation grid elements, which have one or more cross beams only in one of the two mutually remote end regions of the longitudinal beams, also to be made available in addition to the standard grid elements and the transverse compensation grid elements within the framework of a slab formwork system in accordance with the invention. Slab formwork systems can then also be set up using such longitudinal compensation grid elements which have individual, continuously adjustable dimensions not bound to any grid dimension in the direction of the longitudinal beams. It specifically becomes possible by the arrangement of the cross beam or beams in only one end region of the longitudinal beams to push the side of the longitudinal compensation grid elements free of cross beams and lying opposite the cross beam or beams between two adjacent longitudinal beams of a standard grid element or of a transverse compensation grid element over the respectively required path. The pushing in must take place at least so far that the ends of the longitudinal compensation grid element free of cross beams come to lie on cross beams of a standard grid element or of a transverse compensation grid element. The longitudinal compensation grid elements can be pushed so far in at a maximum until their cross beam or cross beams abut the cross beams of a standard grid element or of a transverse compensation grid element. Any desired insertion positions can be selected in a stepless manner between these two extreme positions in order to be able to establish respective individual dimensions in the direction of the longitudinal beams.

The longitudinal compensation grid elements can be inserted when the standard grid elements and/or transverse compensation grid elements adjacent to them are already installed. It is possible in this connection that the cross beam or beams of a longitudinal compensation grid element are arranged outwardly with respect to the total formwork with an installed slab formwork, with the longitudinal beams of the longitudinal compensation grid element facing inwardly. It is, however, alternatively also possible to push a longitudinal compensation grid element from the lower side of another grid element with its end free of cross beams at the front from the inside over a cross beam of the other grid element such that the longitudinal beams of the longitudinal compensation grid element ultimately project outwardly beyond the cross beams of the other grid element in the installed position.

It is furthermore preferred for combination compensation grid elements also to be made available within the framework of the slab formwork system in accordance with the invention which have one or more cross beams arranged inwardly offset in comparison to the longitudinal compensation grid elements only in one of the two mutually remote end regions of the longitudinal beams. A transverse compensation and also a longitudinal compensation can thus be provided simultaneously using combination compensation grid elements of this type. This will be illustrated within the framework of the description of the Figures.

If, in accordance with the invention, in addition to standard grid elements, transverse compensation grid elements, longitudinal compensation grid elements and combination compensation grid elements are used, a constellation can exist with specific installation situations in which a longitudinal beam of a transverse compensation grid element, a longitudinal beam of a longitudinal compensation grid element and also a longitudinal beam of a combination compensation grid element come to lie between two adjacent longitudinal beams of a standard grid element. In this case, the spacing of adjacent longitudinal beams of a standard grid element must then amount to at least three times the width of the longitudinal beams.

It is generally preferred for adjacent longitudinal beams of all grid elements to be spaced apart from one another in an equal manner in each case and/or for the longitudinal beams of all grid elements to have equal lengths among one another.

It is furthermore advantageous for bulk formwork supports between the end regions of two adjacent longitudinal beams to be able to be fastened thereto. In this manner, bulk formwork elements can then be installed on these bulk formwork supports which extend perpendicular to the actual plywood and thus bound and frame a receiving region for the concrete to be applied to the plywood. Bulk formwork supports of this type can be installed particularly simply when the marginal region, in particular the peripheral marginal region, of installed slab formwork is formed practically exclusively by longitudinal beams which extend perpendicular to the respective marginal region. In this case, bulk formwork supports can then be installed at any desired positions between adjacent longitudinal beams.

It is particularly preferred for a longitudinal beam of at least one transverse compensation grid element to be made longer than the spacing between two cross beams of a standard grid element, with the remaining longitudinal beams of the respective transverse compensation grid element simultaneously being dimensioned shorter than the spacing between two cross beams of a standard grid element. It is achieved by this design of a transverse compensation grid element that the transverse compensation grid element does not have to be completely threaded overhead into a standard grid element on the installation. It is rather possible to position the transverse compensation grid element in a position aligned substantially vertical with the longer longitudinal beam above a cross beam of a standard grid element, to subsequently pivot it upwardly in a continued substantially vertical position and then also to position it with the other end of the longer longitudinal beam above a further cross beam of the standard grid element so that the transverse compensation grid element is coupled to the standard grid element in a vertically suspended manner. The transverse compensation grid element can then subsequently be pivoted into a substantially horizontal position. On the last-named pivot procedure, at the end of which the fitter ultimately again has to work overhead, a large part of the weight of the transverse compensation grid element is then already taken up by the cross beams of the standard grid element so that a substantially simplified handling results for the fitter. The named principle will be explained in more detail in the following with reference to FIGS. 9 to 12.

In the last-named preferred embodiment of the invention, it is furthermore advantageous if only one of the longitudinal beams of a transverse compensation grid element lying fully outwardly is made longer than the remaining longitudinal beams of the respective transverse compensation grid element. It is achieved by this measure that the transverse compensation grid element only has to be raised over a height which is as low as possible on the threading of the longer longitudinal beam into a standard grid element.

The longer longitudinal beam of a transverse compensation grid element can project at its two end regions beyond the ends of the shorter longitudinal beam of the respective transverse compensation grid element adjacent to it. It can thus be ensured that the remaining shorter longitudinal beams of the transverse compensation grid element do not collide with cross beams of a standard grid element when the transverse compensation grid element is pivoted into its horizontal position.

The longitudinal extent of the longer longitudinal beam of a transverse compensation grid element can substantially correspond to the spacing of the outer sides of two transverse beams of a standard grid element remote from one another. It is achieved in this manner that the longer longitudinal beam of the transverse compensation grid element does not project beyond the longitudinal beams of that standard grid element into which it was threaded in its assembled state.

The longer longitudinal beam preferably has a smaller cross-section and in particular a lower height than the remaining longitudinal beams of a transverse compensation grid element, with this cross-section in particular being rectangular. It is particularly advantageous for the diagonal dimension of the longer longitudinal beam to be lower than the height of the remaining longitudinal beams. It is hereby achieved that the transverse compensation grid element can also be installed and stripped when plywood lies on the standard grid element with which the transverse compensation grid element is being coupled or is coupled. The longer longitudinal beam then namely does not abut the lower side of this plywood on a pivoting of the transverse compensation grid element due to the dimensions of the longer longitudinal beam.

With an installed slab formwork, the cross beams of all grid elements present in the respective formwork in each case are preferably arranged beneath the longitudinal beams. It is hereby achieved that the upper sides of the longitudinal beams can each form smooth contact surfaces for plywood which is not interrupted by any grooves, recesses or the like provided for upwardly extending cross beams. A direct contact between the plywood and the cross beams therefore does not take place in accordance with the invention since only the upper sides of the longitudinal beams form the contact surface for the plywood.

In addition, it becomes possible by the arrangement of the cross beams beneath the longitudinal beams to be able to place the longitudinal beams of compensation grid elements onto cross beams of standard grid elements so that these cross beams support the compensation grid elements from below.

The invention will be described in more detail in the following with reference to embodiments and to the drawings:

DETAILED DESCRIPTION OF THE INVENTION

Figure 1:
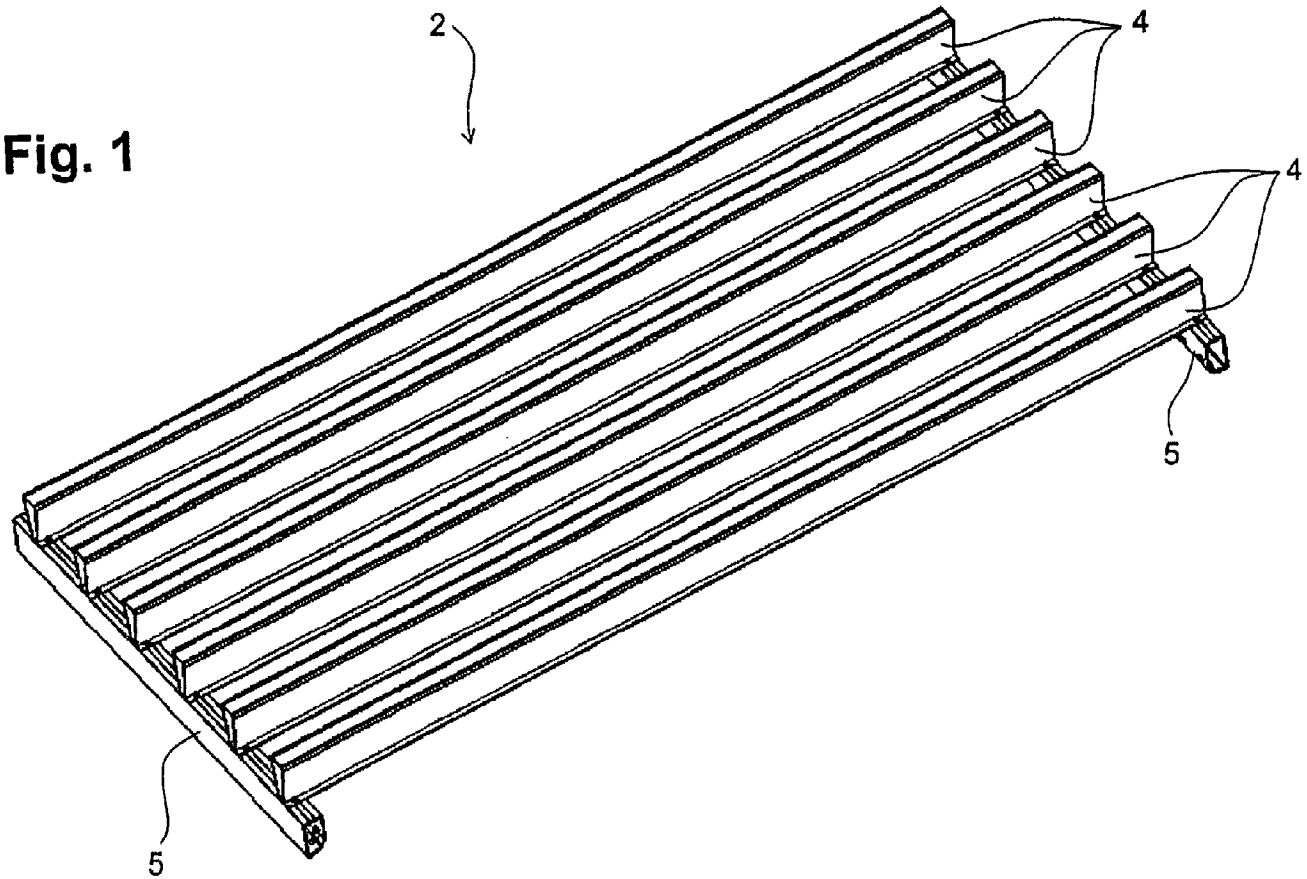
FIG. 1 is a three-dimensional view of a standard grid element.

FIG. 1 shows a standard grid element 2 which consists of a total of six longitudinal beams 4 extending parallel to one another and spaced apart from one another and two cross beams 5. The two cross beams 5 extend perpendicular to the longitudinal beams 4, with a respective cross beam 5 being fastened in each of the two mutually remote end regions of the longitudinal beams 4.

Figure 2:
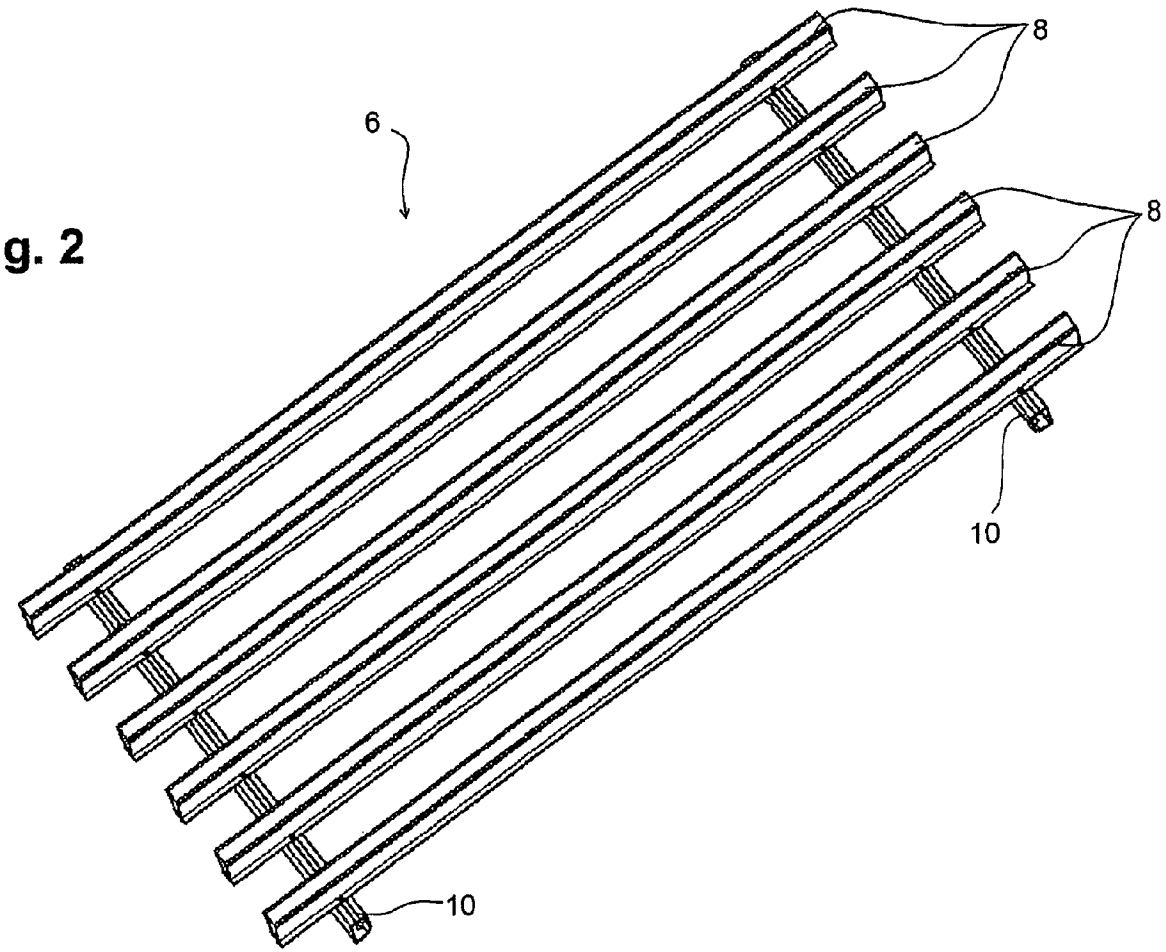
FIG. 2 is a three-dimensional view of a transverse compensation grid element.

FIG. 2 shows a transverse compensation grid element 6 which likewise consists of six longitudinal beams 8 extending parallel to one another and spaced apart from one another and of two cross beams 10 extending perpendicular thereto. The longitudinal beams 10 of the transverse compensation grid element are, however, arranged inwardly offset in comparison to the standard grid element 2 in accordance with FIG. 1 so that they ultimately do not come to lie in the end-face end regions of the longitudinal beams 8. The named offset of the cross beams 10 is much larger than the width of the cross beams 5 of the standard grid element 2; the offset preferably amounts to approximately three times the named width (e.g. approximately 13 cm).

Alternatively, to an arrangement in accordance with FIG. 2, it would, also be possible only to provide one single cross beam which would then likewise have to be arranged inwardly offset in the named manner. Such an individual cross beam could in particular also be provided centrally at the longitudinal beams 8.

Figure 3:
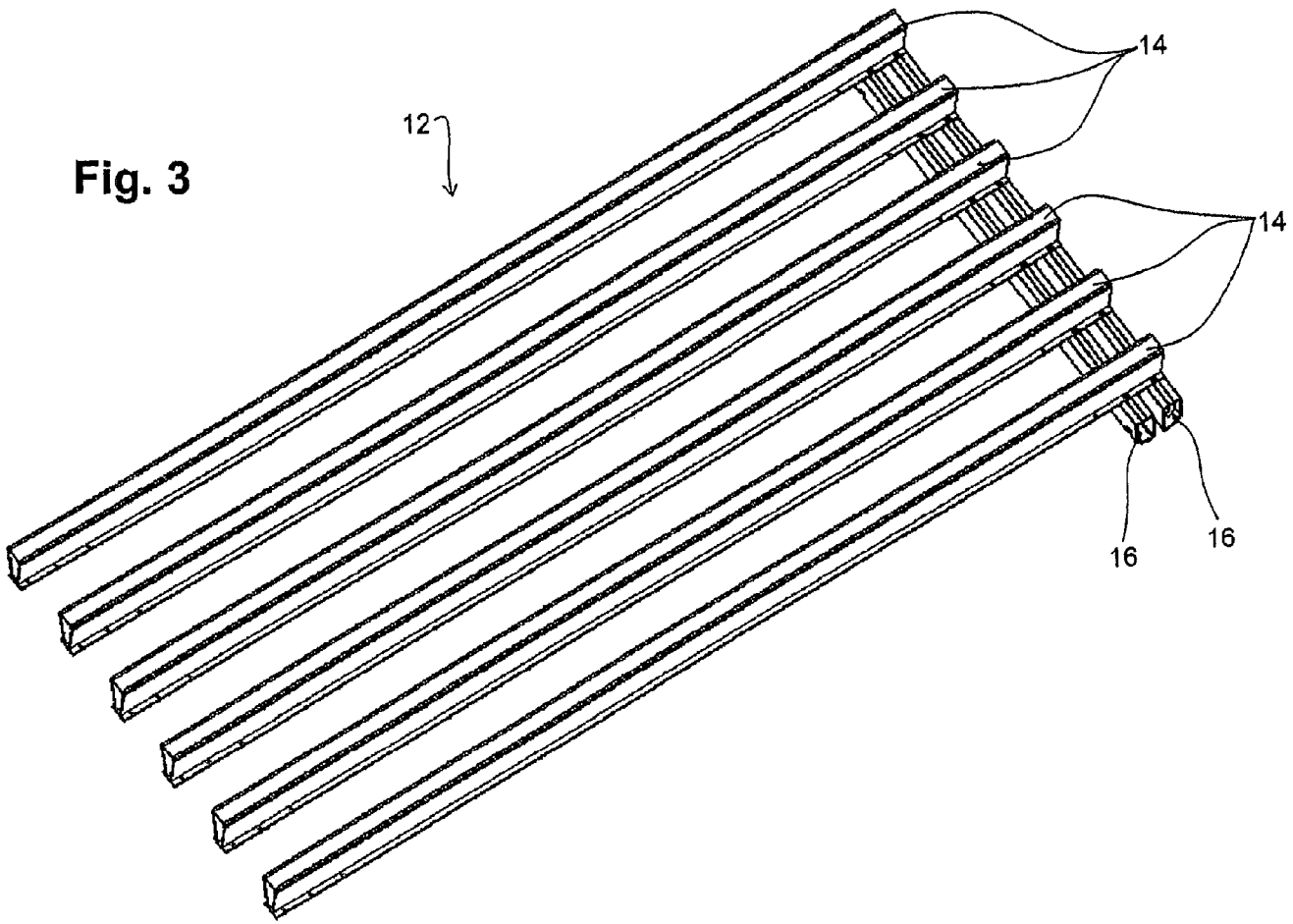
FIG. 3 is a three-dimensional view of a longitudinal compensation grid element.

FIG. 3 shows a longitudinal compensation grid element 12 which in turn consists of six longitudinal beams 14 extending parallel to one another and spaced apart from one another and two cross beams 16 extending perpendicular thereto. The cross beams 16 are, however, in this case both arranged in the same end-face end region of the longitudinal beams 14, which has the result that the oppositely disposed end-face end region of the longitudinal beams 14 is made free of cross beams. Instead of the two cross beams 16 shown in FIG. 3, also only one such cross beam 16 can be used; however, the embodiment with two cross beams 16 is advantageous with respect to the stability of the longitudinal compensation grid element 12.

The mutual spacing of adjacent longitudinal beams 4, 8, 14 is of equal size for all grid elements 2, 6, 12. All the longitudinal beams 4, 8, 14 of all grid elements 2, 6, 12 are likewise each of equal length. This has the result that in each case surfaces of equal size with respect to one another can each be covered by the totality of the longitudinal beams 4, 8, 14 of a grid element 2, 6, 12. Ultimately, all the grid elements 2, 6, 12 therefore have the same sizes among one another.

The upper side of the longitudinal beams 4, 8, 14 in the assembled state of the grid elements 2, 6, 12 forms a contact surface for plywood ultimately to be applied which can consist, for example, of wood sheathing, which is connected in a suitable manner to the upper-side of the longitudinal beams 4, 8, 14.

Respective open sections or hollow sections can be used both for the longitudinal beams 4, 8, 14 and for the cross beams 5, 10, 16, with the same sectional shape being able to be used for all longitudinal beams 4, 8, 14. A specific sectional shape can equally also be used for all cross beams 5, 10, 16. The sectional shape of the longitudinal beams 4, 8, 14 can, however, differ from the sectional shape of the cross beams 5, 10, 16.

In all grid elements 2, 6, 12, the cross beams 5, 10, 16 are located in the assembled state of a slab formwork completely beneath the respective longitudinal beams 4, 8, 14, which means that the longitudinal beams 4, 8, 14 extend in a different plane than the cross beams 5, 10, 16, with the two planes, however, being adjacent to one another.

Longitudinal beams and cross beams 4, 8, 14; 6, 10, 16 can, for example, be welded, screwed or riveted to one another.

Figure 4A:
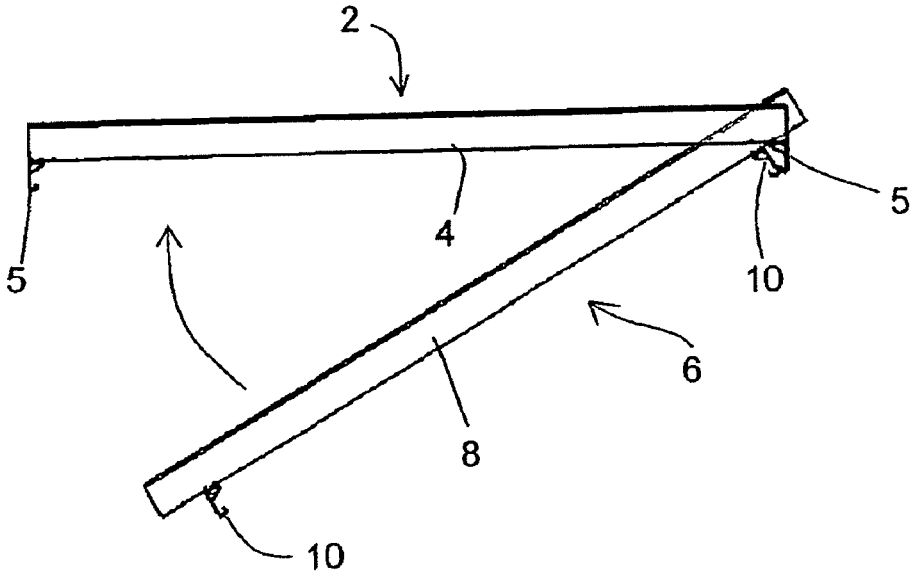
FIGS. 4*a-c* schematically illustrate method steps in the assembly of a transverse compensation grid element at a standard grid element.
Figure 4B:
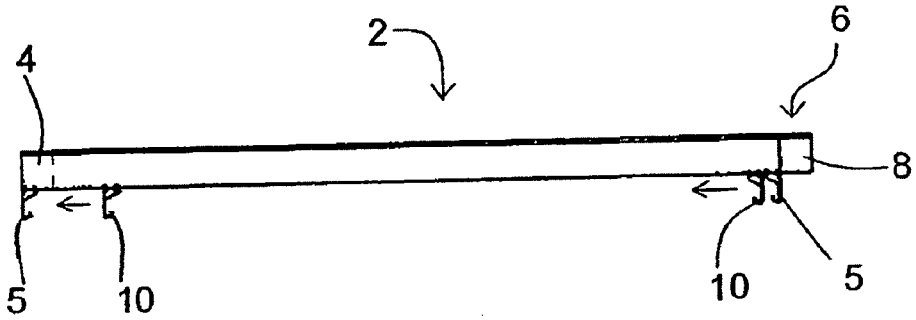

If a transverse compensation grid element 6 should be coupled with an already installed standard grid element 2, in accordance with FIG. 4*a*, a respective desired number of longitudinal beams 8 of the transverse compensation grid element 6 is threaded in between respective adjacent longitudinal beams 4 of a standard grid element 2 until the ends of the threaded in longitudinal beams 8 of the transverse compensation grid element 6 are located above a cross beam 5 of the standard grid element 2. This position is shown in FIG. 4*a*. Starting from this position, the transverse compensation grid element 6 can then be upwardly pivoted in the direction of the arrow around an axis extending in the region of the cross beam 5 until the longitudinal beams 8 of the transverse compensation grid element 6 are located in the same plane as the longitudinal beams 4 of the standard grid element 2. This position is shown in FIG. 4*b*. It becomes clear in accordance with FIG. 4*b* that the longitudinal beams 4, 8 of the two grid elements 2, 6 do not end flush with one another in this assembly stage; it is rather the case that the ends of the longitudinal beams 8 of the transverse compensation grid element 6 project beyond the ends of the longitudinal beams 4 of the standard grid element 2.

Figure 4C:
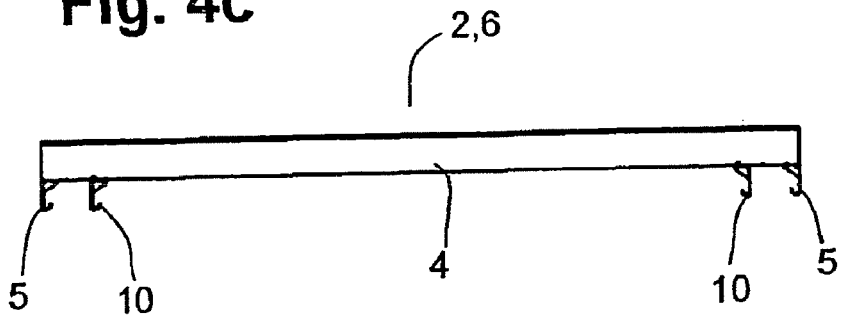

Starting from this position shown in FIG. 4*b*, the transverse compensation grid element 6 is then displaced in a linear manner in the direction of the arrow in accordance with FIG. 4*b* until the end faces of the longitudinal beams 4, 8 of both grid elements 2, 6 are aligned with one another, as is shown in FIG. 4*c*. Due to the inwardly offset arrangement of the cross beams 10 at the transverse compensation grid element 6, the threading of a transverse compensation grid element 6 into a standard grid element 2 described in connection with FIG. 4 becomes possible without the cross beams 5, 10 of both grid elements 2, 6 colliding with one another.

Figure 5:
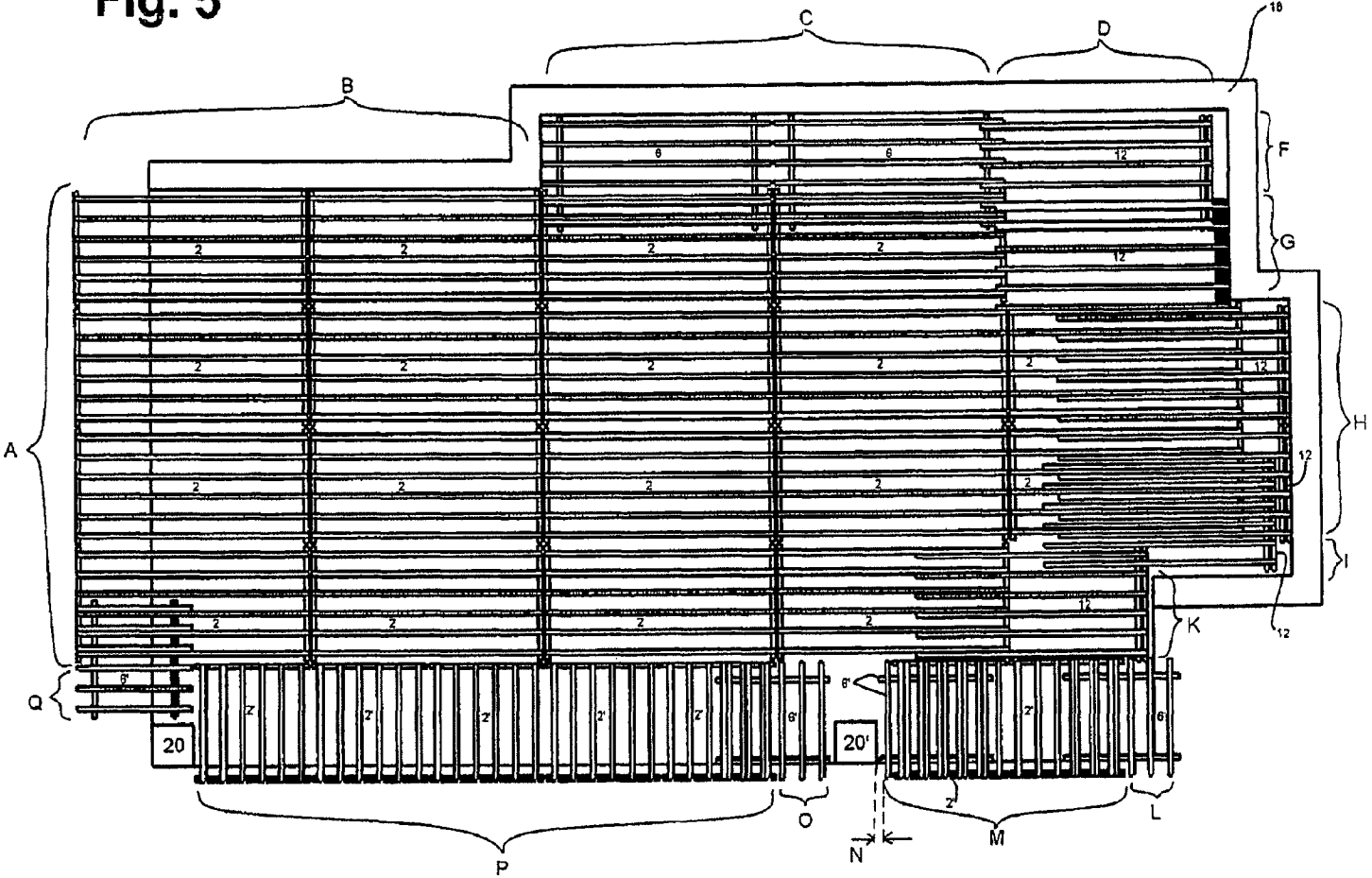
FIG. 5 is a plan view of a completely assembled slab formwork system in accordance with the invention.

FIG. 5 shows a plan view of a completely assembled slab formwork system in accordance with the invention which uses grid elements of two different types in two different sizes. The different sizes of the grid elements 2, 6, 12, on the one hand, and 2', 6', on the other hand, are realized in that the longitudinal beams of the grid elements have lengths differing from one another. Specifically, the length of the longitudinal beams of the grid elements 2', 6' amounts to approximately half the length of the longitudinal beams of the grid elements 2, 6, 12. The spacing of adjacent longitudinal beams is the same with all grid elements 2, 6, 12, 2', 6'. All the grid elements 2, 6, 12, 2', 6' each have six longitudinal beams, which has the result that all the grid elements 2, 6, 12, 2', 6' have equal widths.

The slab formwork in accordance with FIG. 5 adjoins a wall 18 which consists of a total of seven sections each arranged at right angles to one another. Furthermore, the slab formwork system shown also adjoins two freestanding columns 20, 20' which are arranged spaced apart from the wall 18.

For the simpler explanation of the structure of the slab formwork system in accordance with FIG. 5, the mutually adjacent marginal sections of the slab formwork system are designated with sequential letters which will be referenced in the following.

The base of the slab formwork system in accordance with FIG. 5 is formed by a total of sixteen mutually adjacent standard grid elements 2 which are arranged in a 4×4 matrix and thus cover the larger part of the surface of the slab formwork system in accordance with FIG. 5. Five of these standard grid elements 2 form the marginal sections A and B.

In the region of the marginal section C, two transverse compensation grid elements 6 mutually adjoining in the direction of the longitudinal beams are provided which are each meshed with a standard grid element 2 in that the transverse compensation grid elements 6 in accordance with FIG.

4 were threaded into the standard grid elements 2. Two respective longitudinal beams come to lie between adjacent longitudinal beams of the respective standard grid elements 2 with respect to both transverse compensation grid elements 6.

The marginal sections D and F are formed by a longitudinal compensation grid element 12 which is inserted so far into a transverse compensation grid element 6 that the free ends of the longitudinal beams of the longitudinal compensation grid element 12 are supported on a cross beam of the transverse compensation grid element 6. Three longitudinal beams of the longitudinal compensation grid element 12 come to lie between two respective adjacent longitudinal beams of the transverse compensation grid element 6, whereas the three other longitudinal beams of the longitudinal compensation grid element 12 each come to lie between a longitudinal beam of the transverse compensation grid element 6 and a longitudinal beam of that standard grid element 2 which meshes with that transverse compensation grid element 6 on whose cross beams the longitudinal beams of the longitudinal compensation grid element 12 are supported.

The marginal section G is formed by a further longitudinal compensation grid element 12 which is pushed with two longitudinal beams so far into the longitudinal compensation grid element 12 named D with respect to the marginal section that the cross beams of the two longitudinal compensation grid elements 12 come into contact with one another sectionally. The free ends of the longitudinal compensation grid element 12 forming the marginal section G are supported on a cross beam of that standard grid element 2 which meshes with the transverse compensation grid element 6 forming part of the marginal section C.

The marginal section H is formed by two further longitudinal compensation grid elements 12 which are pushed so far into two standard grid elements 2 adjoining one another in the transverse direction that the much larger section of the longitudinal beams of the named longitudinal compensation grid elements 12 are located between the two cross beams of the standard grid elements 2 into which the named longitudinal compensation grid elements 12 were inserted.

A further longitudinal compensation grid element 12 forms the comparatively short marginal section I and in turn a further longitudinal compensation grid element 12 forms the marginal section K. On the assembly of the longitudinal compensation grid elements 12, which form the marginal sections H, I, K, it is necessary to proceed such that first the longitudinal compensation grid element 12 forming the marginal section K, subsequently the longitudinal compensation grid element 12 forming the marginal section I, and finally the two longitudinal compensation grid elements 12 forming the marginal section H are inserted into the respectively already assembled grid elements 2.

All the previously explained marginal sections A to K are formed by grid elements 2, 6, 12 which belong to a first type of grid elements. The marginal sections L to Q mentioned in the following are, in contrast, formed by grid elements 2', 6' which belong to a second type of grid elements. The grid elements of the second type correspond to the grid elements of the first type with the exception of the length of the respective longitudinal beams. The longitudinal beams of the grid elements 2, 6, 12 of the first type are approximately twice as long as the longitudinal beams of the grid elements 2', 6' of the second type.

In the grid elements 2', 6' forming the marginal sections L to P, the longitudinal beams extend perpendicular to the longitudinal beams of those grid elements 2, 6, 12 which form the marginal sections A to K. The grid elements 2', 6', however, adjoin the grid elements 2, 12 directly so that there is no gap between the grid elements 2, 12 of the first type and the grid elements 2', 6' of the second type.

The marginal section M is formed by two standard grid elements 2', with a respective transverse compensation grid element 6' being threaded into each of these two standard grid elements 2' in the manner already explained. The transverse compensation grid element 6' forming the marginal section L was threaded into the corresponding standard grid element 2' such that a total of three longitudinal beams of the transverse compensation grid element 6' come to lie between the respective longitudinal beams of the standard grid element 2'. The transverse compensation grid element 6' forming the comparatively short marginal section N adjoining a schematically illustrated column 20' is, in contrast, arranged such that a total of five of its longitudinal beams are located between the respective longitudinal beams of a standard grid element 2'.

Since, in the slab formwork shown in accordance with FIG. 5, the spacing between two adjacent longitudinal beams of a grid element corresponds to three times the width of the longitudinal beams, transverse compensation grid elements threaded into standard grid elements can be displaced in a direction extending perpendicular to their longitudinal beams by a maximum of twice the width of the longitudinal beams in order thus ultimately to achieve a fine tuning in the transverse compensation to be achieved. It can thus e.g. be seen from FIG. 5 that the longitudinal beams of that transverse compensation grid element 6' which forms the marginal section N are located approximately at the center between two adjacent longitudinal beams of the respective standard grid element 2', whereas the longitudinal beams of the transverse compensation grid element 6' forming the marginal section L directly contact the respective longitudinal beams of the associated standard grid element 2'.

The marginal section P is formed by a total of five directly mutually adjacent standard grid elements 2' whose cross beams abut one another directly at the end faces. A transverse compensation grid element 6', which forms the marginal section O, is in turn threaded into the standard grid element 2' arranged closest to the column 20'.

The marginal section Q adjacent to a further column 20 is finally formed by a further transverse compensation grid element 6' of the second type, which is threaded into a standard grid element 2 of the first type. This shows that transverse compensation grid elements of the second type can also be introduced into standard grid elements of the first type.

Figure 6A:
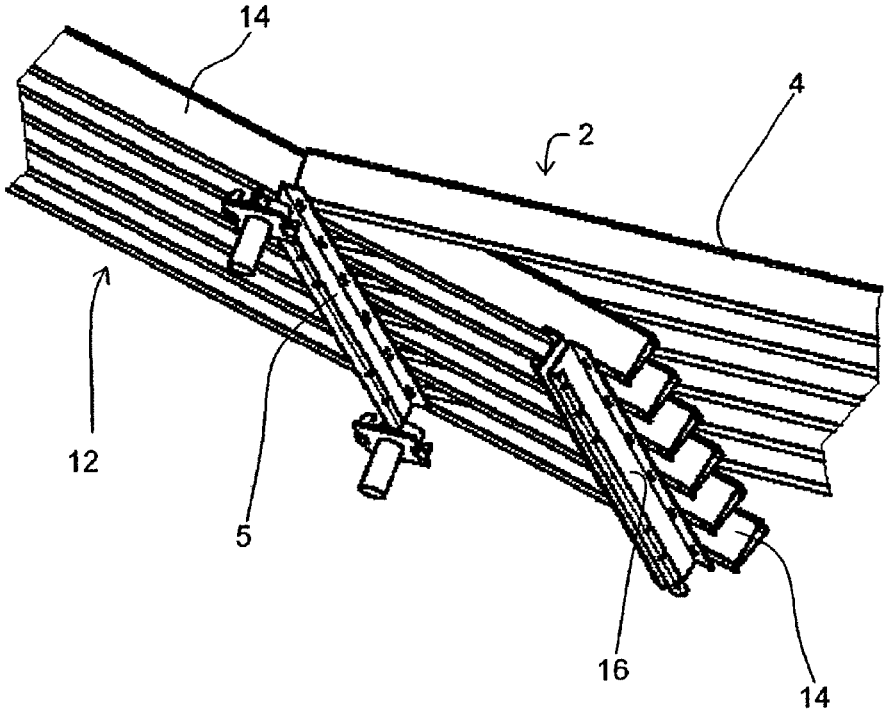
FIG. 6*a* is a three-dimensional view of a standard grid element which is coupled to a longitudinal compensation element before the end of assembly.
Figure 6B:
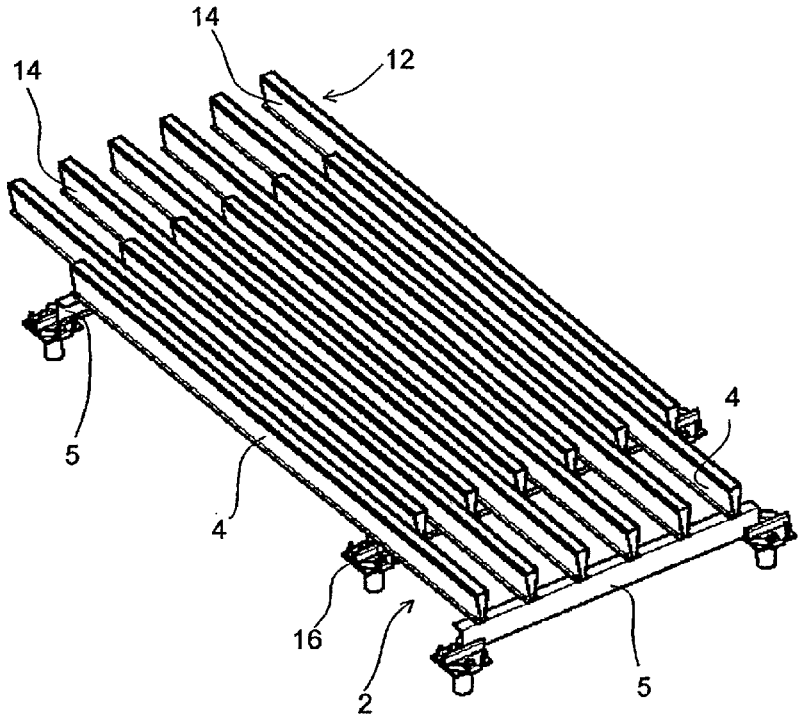
FIG. 6*b* is a view in accordance with FIG. 6*a* after the end of assembly.

FIGS. 6*a, b* show an already assembled standard grid element 2 which has longitudinal beams 4 and cross beams 5 and into which, in accordance with FIG. 6*a*, a longitudinal compensation grid element 12 is threaded from below such that the free ends of the longitudinal beams 14 of the longitudinal compensation grid element 12 are first inserted between the longitudinal beams 4 of the standard grid element 2 and are then pushed over a cross beam 5 of the standard grid element 2 and are finally pivoted such that ultimately the longitudinal beams 14 of the longitudinal compensation grid element 12 in accordance with FIG. 6*b* project beyond the longitudinal beams 4 of the standard grid element 2. In the fully assembled position in accordance with FIG. 6*b*, the upper side of the cross beam 16 of the longitudinal compensation grid element 12 contacts the lower side of the longitudinal beams 4 of the standard grid element 2. It is ensured in this manner that, on an exertion of pressure onto the ends of the longitudinal beams 14 of the longitudinal compensation grid element 12 projecting beyond the longitudinal beams 4, no tilting of the same can occur.

Figure 7:
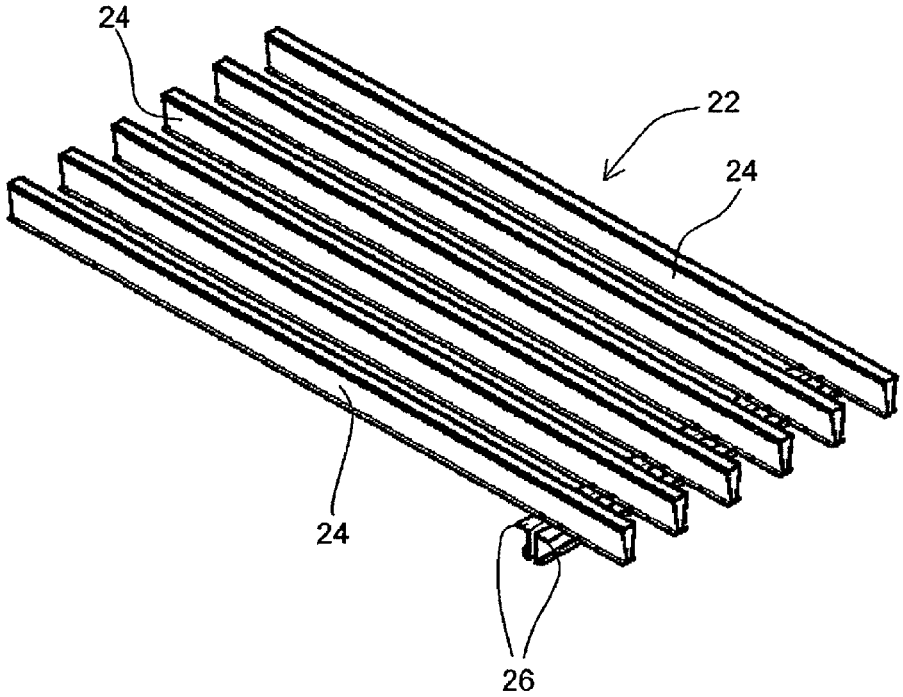
FIG. 7 is a three-dimensional view of a combination compensation grid element.

FIG. 7 shows a combination compensation grid element 22 whose design substantially corresponds to that of a longitudinal compensation grid element 12 in accordance with FIG. 3. The only difference consists of the fact that the cross beams 26 of the combination compensation grid element are arranged inwardly offset with respect to a longitudinal compensation grid element 12, with this offset being able to correspond to that dimension by which the cross beams 10 of a transverse compensation grid element 6 are also inwardly offset. A combination compensation grid element 22 can alternatively also only be fitted with one cross beam 26.

Figure 8:
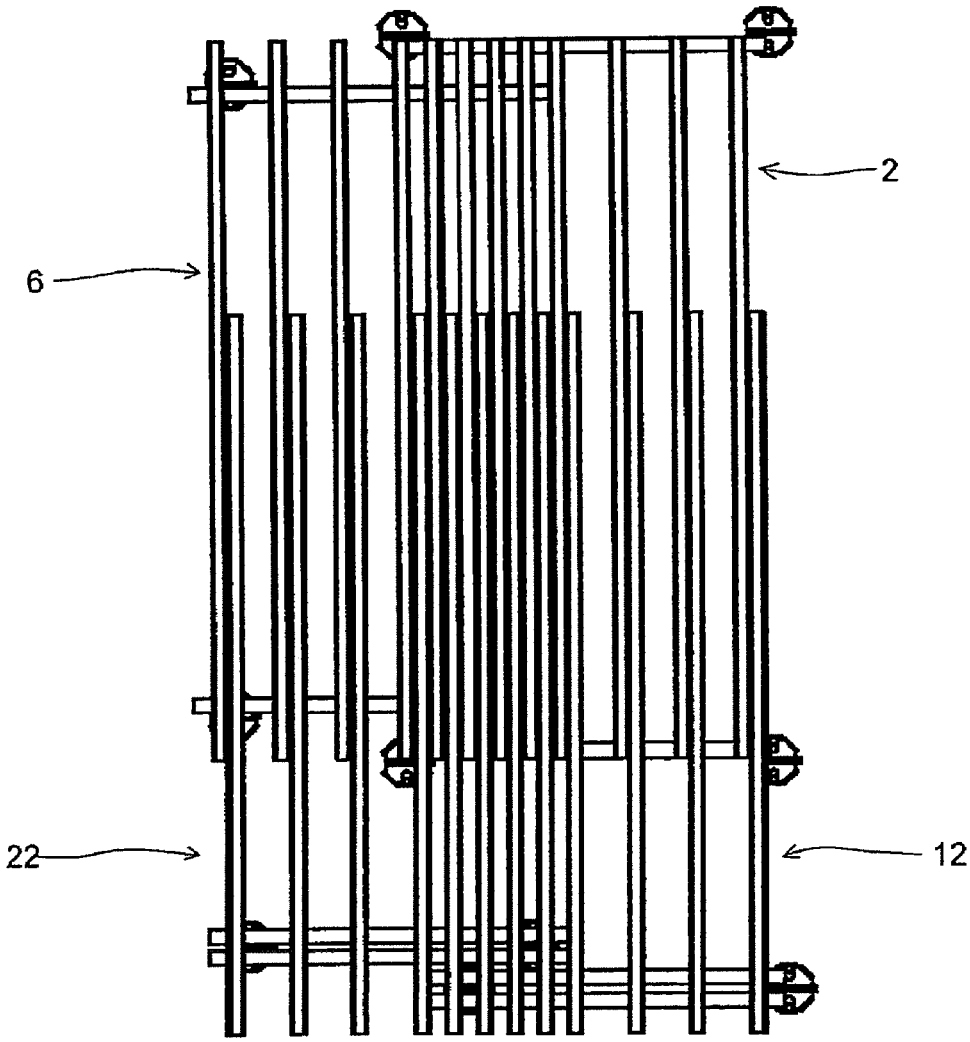
FIG. 8 is a plan view of four grid elements different from one another and coupled to one another.

FIG. 8 shows the manner in which a combination compensation grid element 22 in accordance with FIG. 7 can be used to realize a longitudinal compensation and a transverse compensation simultaneously.

In accordance with FIG. 8, the longitudinal beams of a longitudinal compensation grid element 12 are inserted so far into a standard grid element 2 that the longer region of the longitudinal beams of the longitudinal compensation grid element 12 is located between the longitudinal beams of the standard grid element 2. Furthermore, a transverse compensation grid element 6 was threaded into the standard grid element 2 such that two longitudinal beams of the transverse compensation grid element 6 are located approximately centrally between longitudinal beams of the standard grid element 2. Individual dimensions are thus realized in the direction of the longitudinal beams of the standard grid element 2 by the longitudinal compensation grid element 12, whereas individual dimensions perpendicular thereto are realized with the transverse compensation grid element 6.

In order ultimately to provide an overall rectangular grid area with an individual length and an individual width, it is necessary also to insert a combination compensation grid element 22 into the already explained arrangement in accordance with FIG. 8. The free ends of the longitudinal beams of such a combination compensation grid element 22 are first moved from below between the longitudinal beams of the longitudinal compensation grid element 12 and then pushed over the respective cross beams of the standard grid element 2 and of the transverse compensation grid element 6 until the combination compensation grid element 22 can be pivoted into that plane in which the already assembled grid elements 2, 6, 12 are arranged. After this pivoting, a cross beam of the combination compensation grid element 22 contacts a cross beam of the longitudinal compensation grid element 12 sectionally. Since the cross beams of the combination compensation grid element 22 are inwardly offset with respect to the cross beams of the longitudinal compensation grid element 12, it is possible to position the longitudinal compensation grid element 12 and the combination compensation grid element 22 with respect to one another such that their respective longitudinal beams are aligned to coincide with one another.

Figure 9:
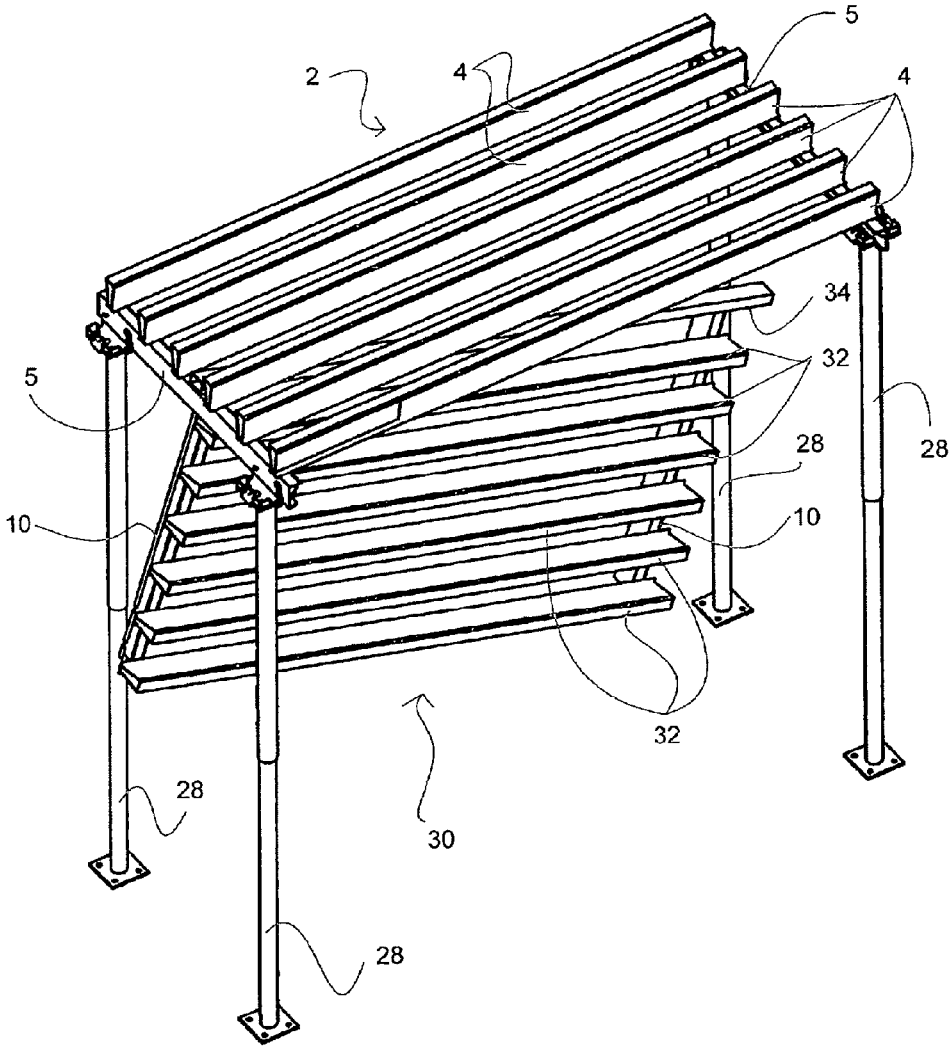
FIG. 9 is a three-dimensional view of a transverse compensation grid element to be coupled to a standard grid element in accordance with a preferred embodiment in a first assembly step.

FIG. 9 shows, in a three-dimensional view, a standard grid element 2 which is supported at the bottom side in its four corner regions via one respective vertical support 28 each. The standard grid element 2 in accordance with FIG. 9 is thus located in a horizontal direction.

Furthermore, FIG. 9 shows a preferred transverse compensation grid element 30 which consists of six shorter longitudinal beams 32, a longer longitudinal beam 34 and two cross beams 10 supporting the longitudinal beams 32, 34 from below. The cross beams 10 extend perpendicular to the longitudinal beams 32, 34 and are arranged somewhat inwardly offset with respect to the end faces of the shorter longitudinal beams 32. The short longitudinal beams 32 are dimensioned shorter than the spacing between the mutually facing inner sides of the cross beams 5 of the standard grid element 2. The longer longitudinal beam 34 has approximately the same length as the longitudinal beams 4 of the standard grid element 2.

Figure 10:
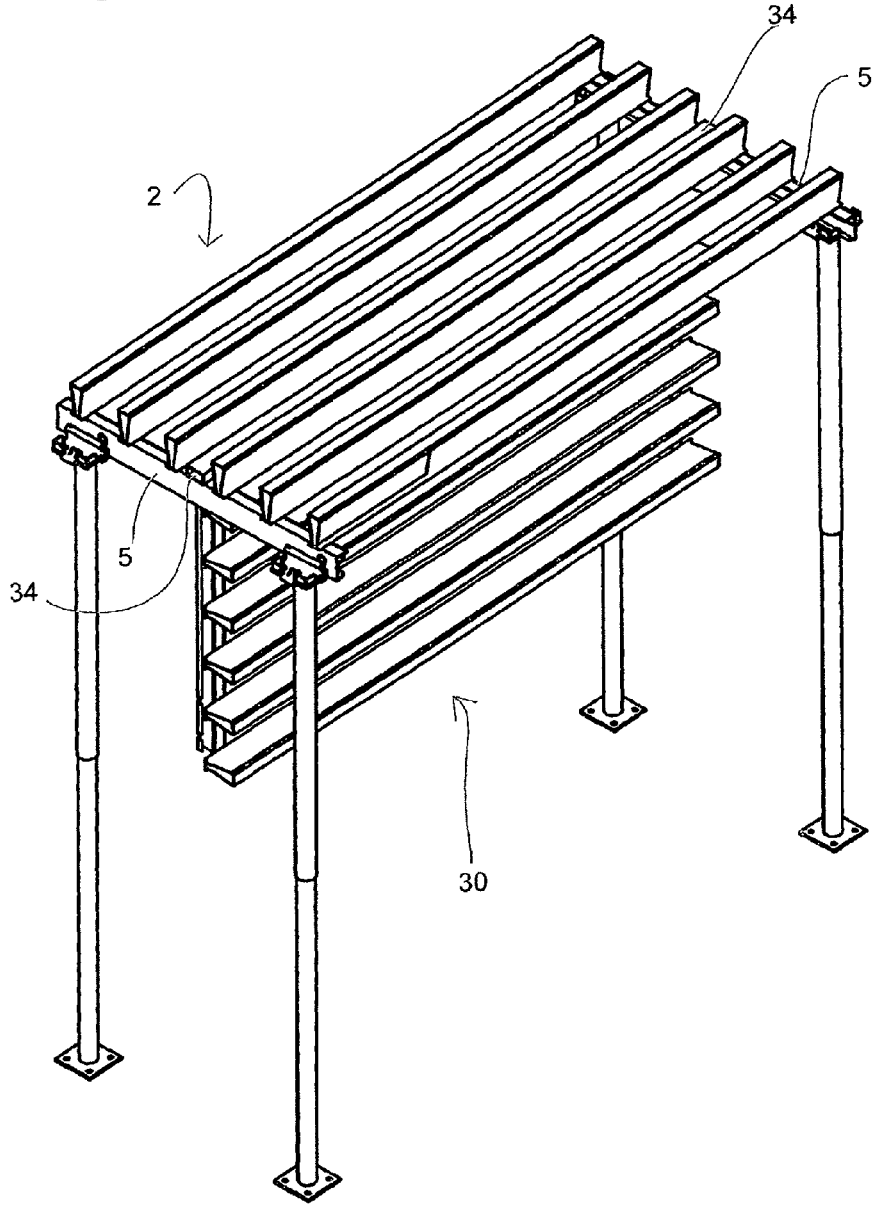
FIG. 10 is a view similar to that of FIG. 9 in a second assembly step.

It is possible on the basis of these arrangements and dimensions, with a substantially vertical alignment shown in FIG. 9 of the transverse compensation grid element 30, to position the one end of the longer longitudinal beam 34 above a cross beam 5 of the standard grid element 2. The transverse compensation grid element 30 can subsequently be pivoted upwardly with a still substantially vertical alignment and then be displaced so far in the longitudinal direction of the longer longitudinal beam 34 until the other end of this longitudinal beam 34 comes to lie above the other cross beam 5 of the standard grid element 2 as is shown in FIG. 10. In this position, the longitudinal beam 34 of the transverse compensation grid element 30 hangs substantially vertically downwardly at the standard grid element 2.

Figure 11:
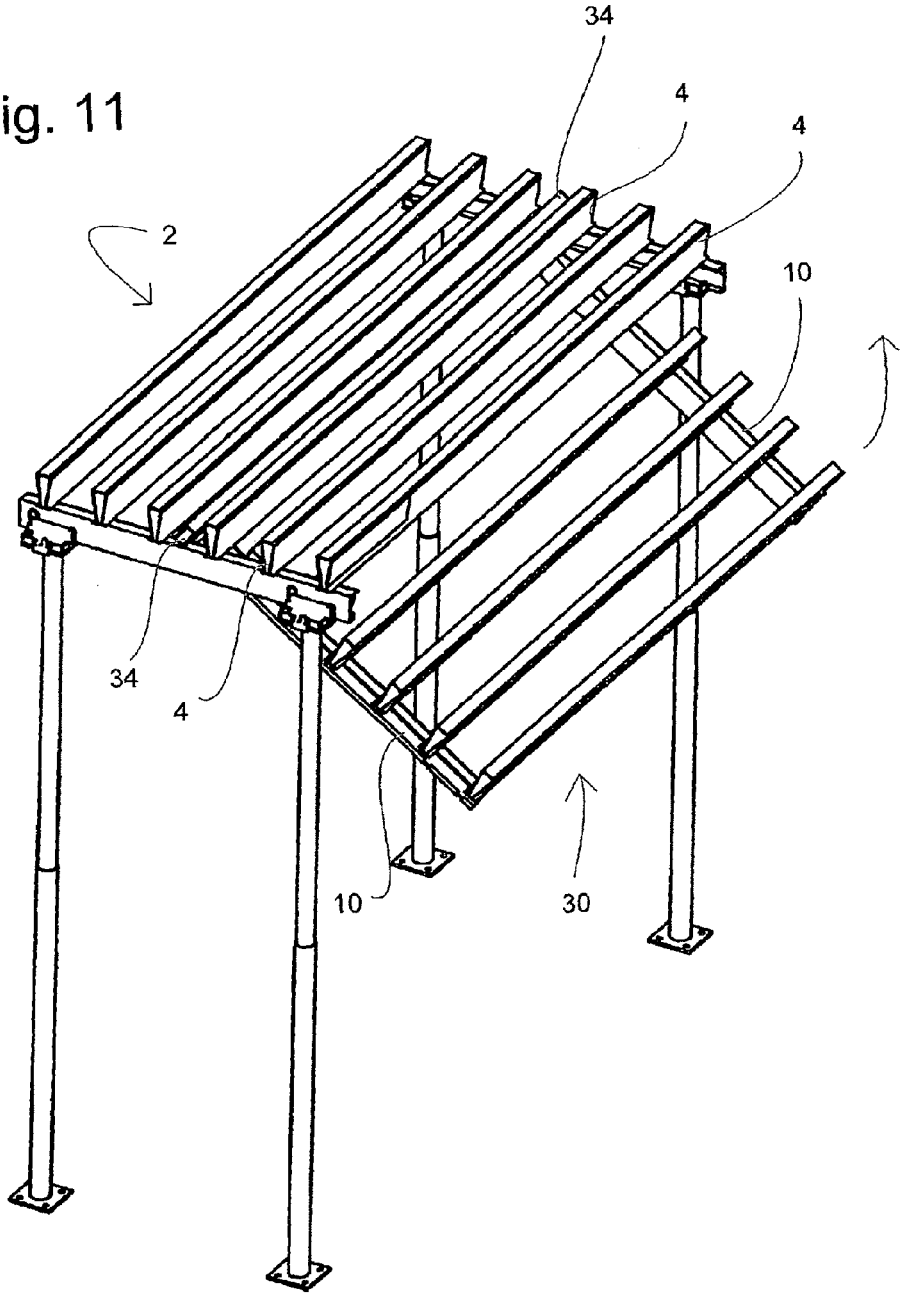
FIG. 11 is a view similar to that of FIG. 9 in a third assembly step.

Starting from the position in accordance with FIG. 10, the transverse compensation grid element 30 can then be pivoted upwardly around the longitudinal axis of the longitudinal beam 34, as is illustrated by the arrow drawn in FIG. 11. On a continued upward pivoting of the transverse compensation grid element 30 in the direction of the arrow of FIG. 11, the upper sides of the cross beams 10 of the transverse compensation grid element 2 ultimately abut the lower sides of the longitudinal beams 4 of the standard grid element 2 such that then both the standard grid element 2 and the transverse compensation grid element 30 are located in a common plane in a substantially horizontally aligned position.

Figure 12:
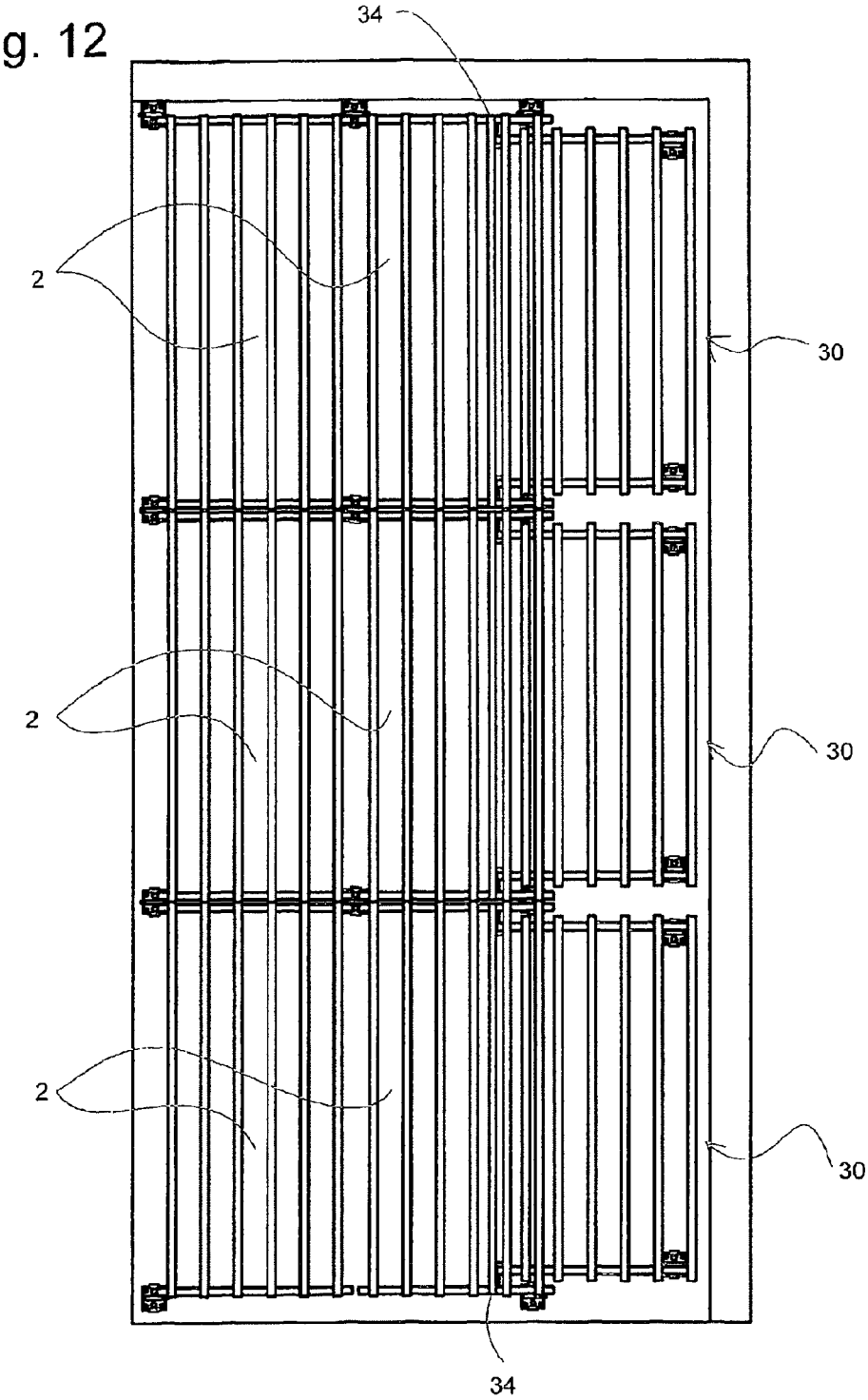
FIG. 12 is a plan view of an arrangement of six standard grid elements and three transverse compensation grid elements which have been coupled to one another in accordance with FIGS. 9 to 11.

The last-named position is illustrated in FIG. 12, in accordance with which three transverse compensation grid elements 30 are coupled with three standard grid elements 2, with this coupling having been effected in accordance with the method steps described in connection with FIGS. 9 to 11.

It can easily be seen that the last-described coupling procedure is simpler to handle for a fitter than the simultaneous threading in of all longitudinal beams 8 of a transverse compensation grid element 6 in accordance with FIG. 2 taking place overhead.

The invention claimed is:

1. A slab formwork system comprising a plurality of grid elements comprising at least one standard grid element and at least one transverse compensation grid element, wherein each grid element comprises:

a plurality of longitudinal beams extending substantially parallel to one another, and at least one cross beam which can be installed on or placed onto vertical supports and extends transversely to the longitudinal beams, wherein the longitudinal beams and cross beams of the grid elements are rigidly connected to one another, wherein the standard grid element comprises two cross beams provided in end regions of the longitudinal beams, and wherein the transverse compensation grid element comprises:

one or two cross beams inwardly offset in comparison to the cross beams of the standard grid element;

a plurality of shorter longitudinal beams, wherein a length of each shorter longitudinal beam is shorter than a spacing between inner sides of the cross beams of the standard grid element; and at least one longer longitudinal beam, wherein a length of the longer longitudinal beam is longer than the spacing between the inner sides of the cross beams of the standard grid element.

2. A slab formwork system in accordance with claim 1, wherein at least one of the longitudinal beams of the transverse compensation grid element is configured to come to lie between two adjacent longitudinal beams of the standard grid element.

3. A slab formwork system in accordance with claim 1, wherein the longitudinal beams of the standard grid element have substantially the same length as the longer longitudinal beam of the transverse compensation grid element.

4. A slab formwork system in accordance with claim 1, wherein the spacing of adjacent longitudinal beams of the grid elements amounts to at most 20 cm and to at least the width of the longitudinal beams.

5. A slab formwork system in accordance with claim 1, further comprising at least one longitudinal compensation grid element, wherein the longitudinal compensation grid element comprises one or more cross beams in a first end region of the longitudinal beams of the longitudinal compensation grid element, and wherein the longitudinal compensation grid element has no cross beams in a second end region of the longitudinal beams of the longitudinal compensation grid element.

6. A slab formwork system in accordance with claim 5, wherein the cross beams of the longitudinal compensation grid element are arranged inwardly or outwardly.

7. A slab formwork system in accordance with claim 5, further comprising at least one combination compensation grid element, wherein the combination compensation grid element comprises one or more cross beams inwardly offset in comparison to the longitudinal compensation grid elements only in one end region of the longitudinal beams of the combination compensation grid element.

8. A slab formwork system in accordance with claim 1, further comprising bulk formwork supports configured to be fastened between the end regions of two adjacent longitudinal beams.

9. A slab formwork system in accordance with claim 1, wherein an installed slab formwork comprises a periphery formed by longitudinal beams which extend perpendicular to the edge of the periphery.

10. A slab formwork system in accordance with claim 1, wherein the transverse compensation grid element comprises exactly one longer longitudinal beam, wherein the longer longitudinal beam is disposed at an edge of the transverse compensation grid element.

11. A slab formwork system in accordance with claim 1, wherein the longer longitudinal beam of the transverse compensation grid element is configured to project at its two end regions over the ends of the longitudinal beam of the transverse compensation grid element adjacent to the transverse compensation grid element.

12. A slab formwork system in accordance with claim 1, wherein the length of the longer longitudinal beam of the transverse compensation grid element is substantially equal to the spacing between the outer sides of the cross beams of the standard grid element.

13. A slab formwork system in accordance with claim 1, wherein the longer longitudinal beam of the transverse compensation grid element has a smaller cross-section than the shorter longitudinal beams.

14. A slab formwork system in accordance with claim 1, wherein the longer longitudinal beam of the transverse compensation grid element has a rectangular cross-section, with a diagonal dimension of the cross-section being smaller than the height of the shorter longitudinal beams.

15. A slab formwork system in accordance with claim 1, wherein, with an installed slab formwork, the cross beams of all present grid elements are disposed beneath the longitudinal beams.

16. A slab formwork system in accordance with claim 1, wherein the spacing of adjacent longitudinal beams of the grid elements amounts to at most 20 cm and to at least three times the width of the longitudinal beams.

17. A slab formwork system comprising at least one standard grid element, at least one transverse compensation grid element, and at least one longitudinal compensation grid element, wherein each grid element comprises:

a plurality of longitudinal beams extending substantially parallel to one another, and at least one cross beam which can be installed on or placed onto vertical supports and extends transversely to the longitudinal beams, wherein the longitudinal beams and cross beams of the grid elements are rigidly connected to one another, wherein the standard grid element comprises two cross beams provided in end regions of the longitudinal beams, wherein the transverse compensation grid element comprises:

one or two cross beams inwardly offset in comparison to the cross beams of the standard grid elements, and wherein both a longitudinal beam of the transverse compensation grid element and a longitudinal beam of the longitudinal compensation grid element are configured to come to lie between two adjacent longitudinal beams of the standard grid element.

18. A slab formwork system comprising at least one standard grid element, at least one transverse compensation grid element, at least one longitudinal compensation grid element, and at least one combination compensation grid element, wherein each grid element comprises:

a plurality of longitudinal beams extending substantially parallel to one another, and at least one cross beam which can be installed on or placed onto vertical supports and extends transversely to the longitudinal beams, wherein the longitudinal beams and cross beams of the grid elements are rigidly connected to one another, wherein the standard grid element comprises two cross beams provided in end regions of the longitudinal beams, wherein the transverse compensation grid element comprises:

one or two cross beams inwardly offset in comparison to the cross beams of the standard grid elements, and wherein a longitudinal beam of the transverse compensation grid element, a longitudinal beam of the longitudinal compensation grid element, and a longitudinal beam of the combination compensation grid element are configured to come to lie between two adjacent longitudinal beams of the standard grid element.

* * * * *